US005713669A

United States Patent [19]

Thomas et al.

[11] Patent Number: 5,713,669

[45] Date of Patent: Feb. 3, 1998

[54] PLASTIC BAG WITH ZIPPER SLIDER CAPTURED IN POCKET

[75] Inventors: Toby R. Thomas, Pittsford; David G. Vanderlee, Macedon, both of N.Y.

[73] Assignee: Tenneco Packaging, Evanston, Ill.

[21] Appl. No.: 760,479

[22] Filed: Dec. 5, 1996

[51] Int. Cl.[6] ..... B65D 33/16

[52] U.S. Cl. ..... 383/204; 383/61; 383/64; 383/81; 383/209; 383/210

[58] Field of Search ..... 383/61, 64, 78, 383/81, 5, 204, 209, 210, 211

[56] References Cited

U.S. PATENT DOCUMENTS

| | | | |
|---|---|---|---|
| Re. 33,674 | 8/1991 | Uramoto | 206/620 |
| Re. 34,554 | 3/1994 | Ausnit | 383/63 |
| 3,172,443 | 3/1965 | Ausnit | 383/210 |
| 3,226,787 | 1/1966 | Ausnit | 383/61 |
| 3,780,781 | 12/1973 | Uramoto | 150/3 |
| 4,196,030 | 4/1980 | Ausnit | 156/91 |
| 4,337,889 | 7/1982 | Moertel | 383/61 |
| 4,923,309 | 5/1990 | VanErden | 383/5 |
| 4,927,271 | 5/1990 | Branson | 383/61 |
| 4,966,470 | 10/1990 | Thompson et al. | 383/5 |
| 4,971,454 | 11/1990 | Branson et al. | 383/81 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,023,122 | 6/1991 | Boeckmann et al. | 428/43 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,077,064 | 12/1991 | Hustad et al. | 383/5 |
| 5,088,971 | 2/1992 | Herrington | 493/203 |
| 5,092,684 | 3/1992 | Weeks | 383/61 |
| 5,092,831 | 3/1992 | James et al. | 493/394 |
| 5,116,301 | 5/1992 | Robinson et al. | 493/215 |
| 5,121,997 | 6/1992 | LaPierre et al. | 383/203 |
| 5,129,734 | 7/1992 | Van Erden | 383/61 |
| 5,131,121 | 7/1992 | Herrington, Jr. et al. | 24/436 |
| 5,161,286 | 11/1992 | Herrington, Jr. et al. | 24/387 |
| 5,186,543 | 2/1993 | Cochran | 383/203 |
| 5,189,764 | 3/1993 | Herrington et al. | 24/387 |
| 5,211,482 | 5/1993 | Tilman | 383/202 |
| 5,224,779 | 7/1993 | Thompson et al. | 383/5 |
| 5,283,932 | 2/1994 | Richardson et al. | 24/400 |
| 5,301,394 | 4/1994 | Richardson et al. | 24/399 |
| 5,301,395 | 4/1994 | Richardson et al. | 24/400 |
| 5,405,478 | 4/1995 | Richardson et al. | 156/308.4 |
| 5,426,830 | 6/1995 | Richardson et al. | 24/430 |
| 5,431,760 | 7/1995 | Donovan | 156/66 |
| 5,435,864 | 7/1995 | Machacek et al. | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,456,928 | 10/1995 | Hustad et al. | 426/87 |
| 5,480,230 | 1/1996 | May | 383/61 |
| 5,482,375 | 1/1996 | Richardson et al. | 383/64 |

*Primary Examiner*—Stephen P. Garbe
*Attorney, Agent, or Firm*—Arnold, White & Durkee

[57] ABSTRACT

A reclosable plastic bag comprises first and second opposing body panels, a zipper, a slider, and first and second upstanding panels. The opposing body panels are fixedly connected to each other along a pair of sides and a bottom bridging the pair of sides. The zipper extends along a mouth formed opposite the bottom. The zipper includes a first track with a first profile and a second track with a second profile. The first and second profiles are releasably engageable to each other. The slider is slidably mounted to the zipper for movement between a closed position and an open position. The first and second profiles are engaged to each other while the slider is in the closed position, and the first and second profiles are disengaged from each other in response to movement of the slider from the closed position to the open position. The first and second upstanding panels extend upwardly from the respective first and second body panels. Each of the upstanding panels includes opposing ends, and the opposing ends of the first upstanding panel are connected to the respective opposing ends of the second upstanding panel to form an open pocket in which the slider and zipper are captured. The open pocket may be sealed by joining the first and second upstanding panels to each other above the slider so as to completely encapsulate the slider within the pocket.

11 Claims, 2 Drawing Sheets

PLASTIC BAG WITH ZIPPER SLIDER CAPTURED IN POCKET

FIELD OF THE INVENTION

The present invention generally relates to reclosable plastic bags and, more particularly, to a reclosable plastic bag including a zipper slider captured in a pocket. The pocket furnishes end terminations that prevent the slider from going past the ends of the zipper and provide adequate end strength that resists stresses applied to the zipper profiles during normal use of the bag.

BACKGROUND OF THE INVENTION

A reclosable plastic bag typically includes first and second opposing panels fixedly connected to each other along a pair of sides and a bottom bridging the pair of sides. The first and second panels are not fixedly connected along a mouth which is formed opposite to the sealed bottom. Rather, the bag is provided with a reclosable zipper extending along the mouth of the plastic bag. The zipper includes a male track and a female track. In reclosable plastic bags of the type disclosed in U.S. Pat. No. 5,067,208 utilizing a slider to open the zipper, the male track typically includes a male profile and a first fin extending downward from the male profile. Likewise, the female track in such bags with sliders includes a female profile and a second fin extending downward from the female profile. The first and second fins are thermally fused to the inner surfaces of the respective first and second panels.

The male and female tracks are typically free of any plastic material above the male and female profiles in order to permit proper mounting and movement of the slider. The male and female profiles are releasably engageable to each other. When the slider is in a closed position, the male and female profiles are interlocked with each other. In response to moving the slider to an open position, the male and female profiles are disengaged from each other. Once the male and female profiles are disengaged from each other, access to the interior of the bag may be obtained by pulling the first and second panels apart at the mouth.

It is desirable to provide opposite ends of the zipper with end terminations. The end terminations perform the dual function of stops for the ends of the zipper to prevent the slider from going past the ends of the zipper and, in addition, they hold the male and female profiles together to resist stresses applied to the profiles during normal use of the plastic bag. In U.S. Pat. No. 5,067,208, each end termination is in the form of a strap/clip that wraps over the top of the zipper. One end of the strap is provided with a rivet-like member that penetrates through the zipper fins and into a cooperating opening at the other end of the strap. Other types of end terminations are disclosed in U.S. Pat. Nos. 5,482,375, 5,448,807, 5,442,837, 5,405,478, 5,161,286, 5,131,121, and 5,088,971.

Reclosable plastic bags of the foregoing type are a great convenience to the consumer especially for products such as deli meats and cheeses where, typically, only a portion of the product is used at any given time. A problem with these reclosable bags, however, is that if such plastic bags are to be prepackaged with a food product and then sold in a grocery store, the contents of the plastic bags can easily be tampered with prior to purchase by the consumer. Therefore, in addition to providing end terminations, it is desirable to provide such prepackaged bags with some sort of tamper-evident feature.

SUMMARY OF THE INVENTION

A reclosable plastic bag includes first and second opposing body panels fixedly connected to each other along a pair of sides and a bottom bridging the pair of sides. The bag is provided with a reclosable zipper extending along a mouth formed opposite the sealed bottom of the plastic bag. The zipper includes a male track and a female track. The male track includes a male profile and a first depending fin extending downward from the male profile. Likewise, the female track includes a female profile and a second depending fin extending downward from the female profile. If the zipper is formed separately from the body panels of the bag, the first and second depending fins are thermally fused to inner surfaces of the respective first and second body panels. Alternatively, the zipper may be extruded with the body panels of the bag.

A slider is slidably mounted to the zipper for movement between a closed position and an open position. The male and female profiles are engaged to each other while the slider is in the closed position. The male and female profiles are disengaged from each other in response to movement of the slider to the open position.

First and second upstanding panels extend upwardly from the respective first and second body panels. Each of the upstanding panels includes opposing ends, and the opposing ends of the first upstanding panel are connected to the respective opposing ends of the second upstanding panel to form an open pocket in which the slider and zipper are captured. The open pocket effectively creates end terminations that serve to prevent the slider from going past the ends of the zipper and to provide adequate end strength that resists stresses applied to the profiles during normal use of the bag. To minimize tampering with the plastic bag, the open pocket may be sealed by joining the first and second upstanding panels to each other above the slider so as to completely encapsulate the slider within the pocket.

BRIEF DESCRIPTION OF THE DRAWINGS

Other objects and advantages of the invention will become apparent upon reading the following detailed description and upon reference to the drawings in which.

Figure 1:
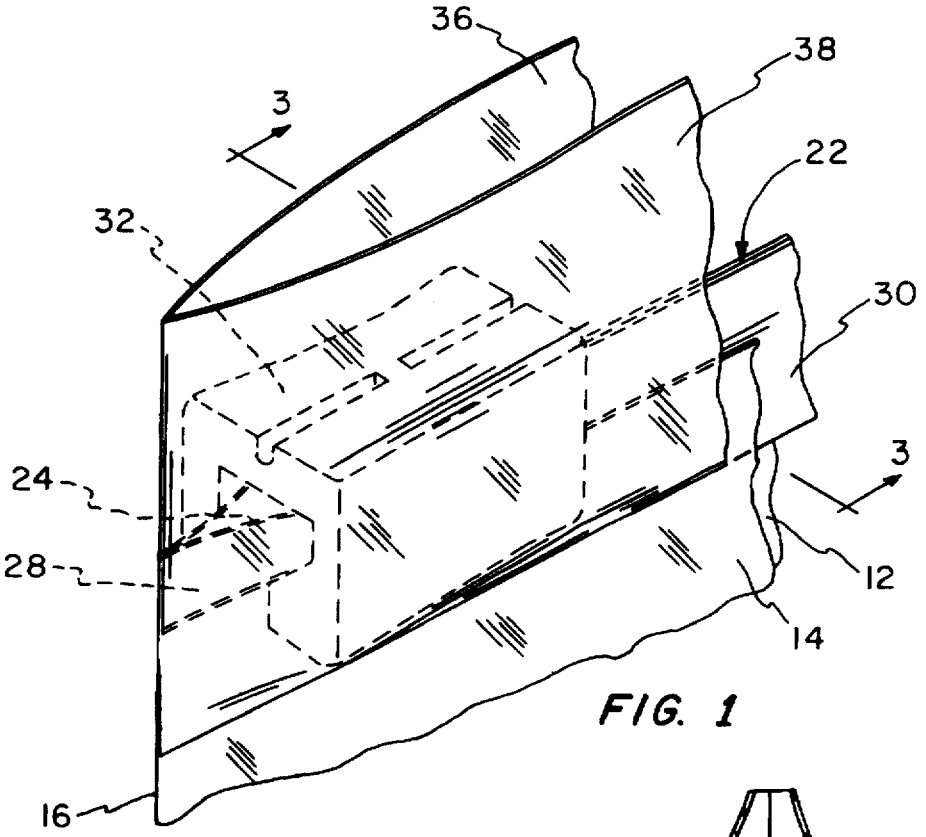
FIG. 1 is an isometric view of a mouth portion of a reclosable plastic bag showing a slider captured within a pocket.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Figure 2:
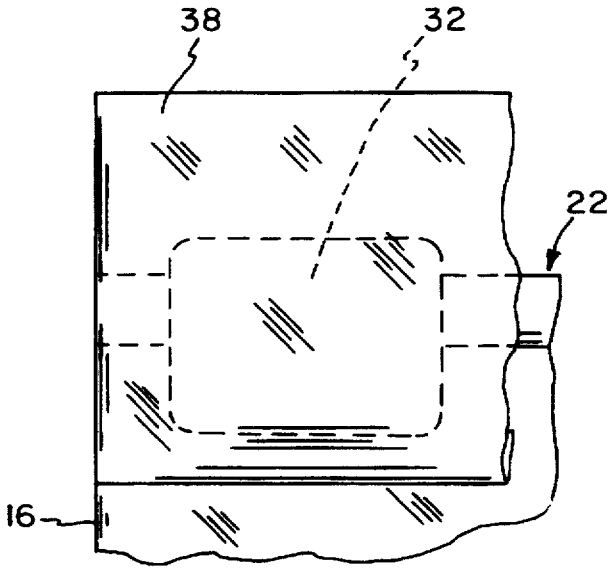
FIG. 2 is a front view of the bag mouth portion in FIG. 1.
Figure 3:
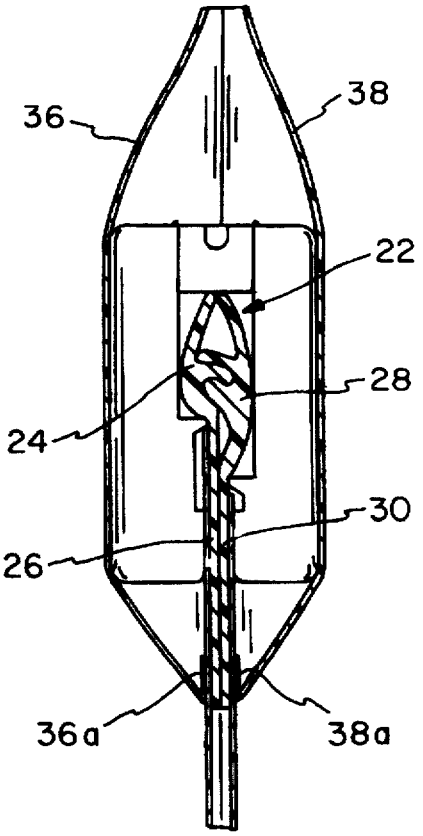
FIG. 3 is a sectional view taken generally along the line 3—3 in FIG. 1.

Turning now to the drawings, FIGS. 1–3 depict a mouth portion of a reclosable plastic bag embodying the present invention. The plastic bag comprises first and second opposing body panels 12 and 14 fixedly connected to each other along a pair of sides 16 and 18 (see FIGS. 4 and 5) and a bottom 20 (see FIGS. 4 and 5) bridging the pair of sides 16 and 18. The bag is provided with a reclosable zipper 22 extending along the mouth portion, which is formed opposite the sealed bottom 20 of the plastic bag.

The zipper 22 includes a male track and a female track. The male track includes a male profile 24 and a first depending fin or flange 26 extending downward from the male profile 24. Likewise, the female track includes a female profile 28 and a second depending fin or flange 30 extending downward from the female profile 28. If the zipper 22 is formed separately from the body panels 12 and 14 of the bag, the first and second fins 26 and 30 are thermally fused to inner surfaces of the respective first and second body panels 12 and 14. Alternatively, the zipper 22 may be extruded with the panels 12 and 14 such that the first fin 26 is integrally formed with the first body panel 12 and the second fin 30 is integrally formed with the second body panel 14.

To assist in opening the plastic bag, a slider 32 is slidably mounted to the zipper 22 for movement between a closed position and an open position. In the closed position of the slider 32, the male and female profiles 24 and 28 are interlocked with each other. Movement of the slider 32 from the closed position toward the open position disengages the male and female profiles 24 and 28 from each other and allows a user to gain access to the interior of the plastic bag. Further details concerning the construction and operation of the zipper 22 and slider 32 may be obtained from U.S. Pat. No. 5,067,208 to Herrington, Jr. et al., which is incorporated herein in its entirety by reference.

First and second upstanding panels 36 and 38 extend upwardly from the respective first and second body panels 12 and 14. The first upstanding panel 36 is integrally formed with the first body panel 12, and a lowermost strip **36*a* (FIG. 3) of the first upstanding panel 36 is thermally fused to an outer surface of an uppermost strip of the first body panel 12. Likewise, the second upstanding panel 38 is integrally formed with the second body panel 14, and a lowermost strip 38*a* (FIG. 3) of the second upstanding panel 38 is thermally fused to an outer surface of an uppermost strip of the second body panel 14**.

Each of the upstanding panels 36 and 38 includes opposing vertical ends in line with the sides 16 and 18, and the opposing vertical ends of the first upstanding panel 36 are thermally fused to the respective opposing vertical ends of the second upstanding panel 38 along the sides 16 and 18 to form a pocket in which the slider 32 and zipper 22 are captured. The pocket serves the dual function of end terminations, which is to prevent the slider 32 from going past the ends of the zipper 22 and to provide adequate end strength that resists stresses applied to the profiles 24 and 28 during normal use of the bag.

Figure 4:
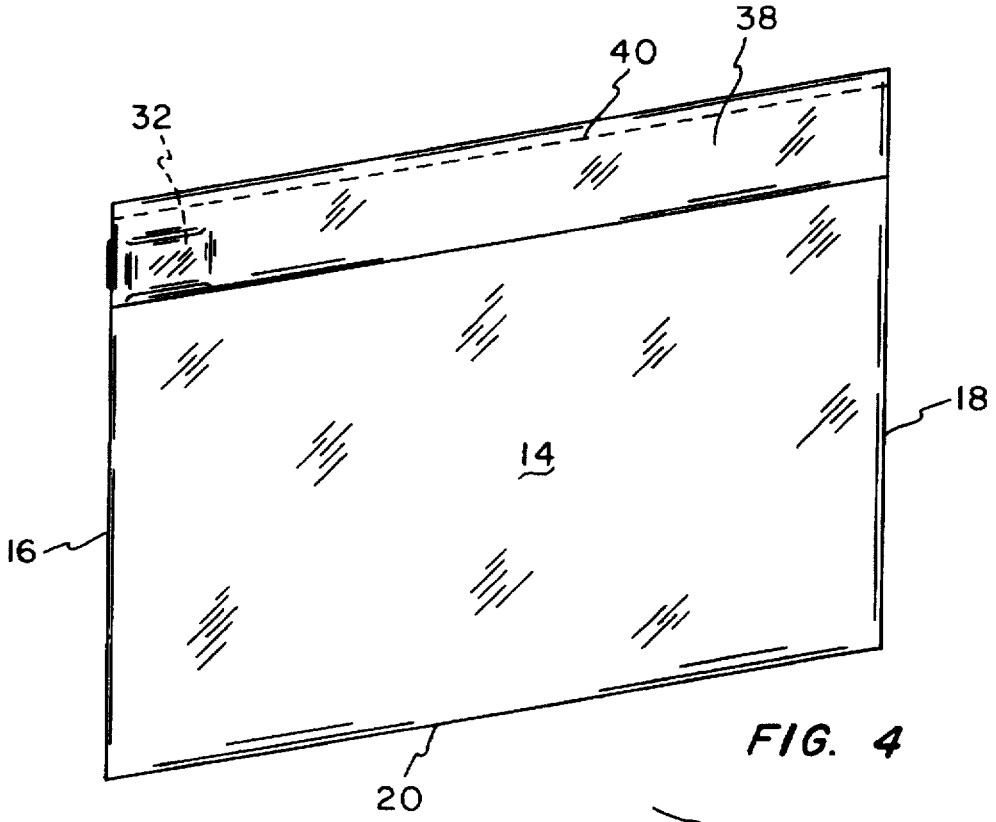
FIG. 4 is an isometric view of the reclosable plastic bag showing the slider captured within a sealed pocket.
Figure 5:
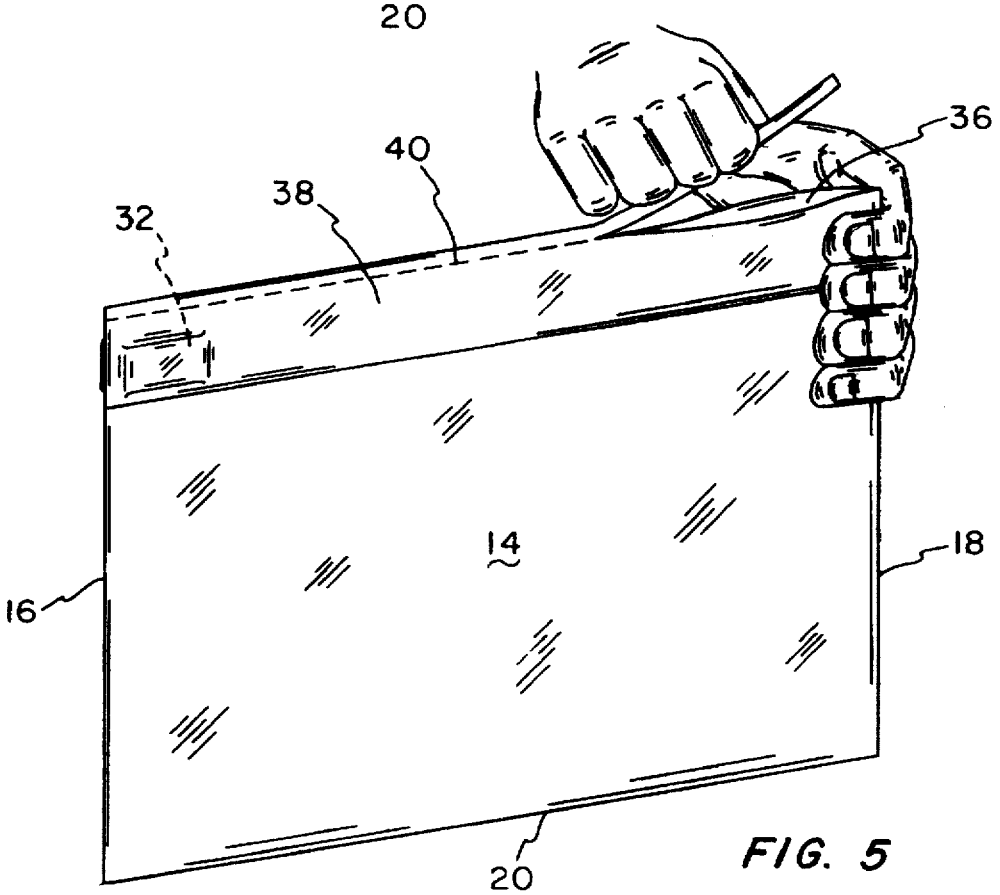
FIG. 5 is an isometric view of the reclosable plastic bag in FIG. 4 showing the seal on the pocket in the process of being broken.

Referring now to FIGS. 4 and 5, if the plastic bag is used to prepackage food products such as dell meats and cheeses which are later sold in a grocery store, it is desirable to provide the plastic bag with a tamper-evident feature. The first and second upstanding panels 36 and 38 are ideally suited for this purpose. To minimize tampering with the plastic bag, upper edges of the respective first and second upstanding panels 36 and 38 are joined to each other to seal the pocket and completely encapsulate the slider 32 and zipper 22 within the sealed pocket. The upper edges of the respective first and second upstanding panels 36 and 38 may be joined to each other either by thermal fusion or by integrally forming these upper edges with each other. When the upper edges are integrally formed with each other, the first and second upstanding panels are created from a single folded piece of film where the fold is disposed along the upper edges and the slider 32 and zipper 22 are effectively located in the area of the fold.

To permit a consumer to gain access to the interior of the plastic bag when the pocket is sealed for tamper-evident purposes, the sealed pocket is preferably provided with a one-time breakable seal. If the consumer purchases a prepackaged plastic bag with the one-time breakable seal intact, it is highly unlikely that the contents of the plastic bag have been tampered with because the zipper 22 cannot easily be opened without breaking the seal. Even if the zipper 22 could be opened without breaking the seal, access to the interior of the plastic bag via the opened zipper 22 is difficult because the zipper 22 is still encapsulated in the sealed pocket. If, on the other hand, the consumer purchases a plastic bag with the one-time breakable seal broken, then it is more likely that the contents of the plastic bag have been tampered with.

The one-time breakable seal for restricting access to the slider 32 and zipper 22 may take several forms. For example, the upstanding panels 36 and 38 may include respective parallel lines of weakness 40 extending between the sides 16 and 18 of the bag and oriented generally parallel to the zipper 22. The lines of weakness 40 may be perforated lines, score lines, or thinned/die lines (less plastic extruded along the lines). To break such a one-time breakable seal, a consumer tears away upper portions of the upstanding panels 36 and 38 along the lines of weakness 40 as shown in FIG. 5. The upstanding panels 36 and 38 may be thermally fused to each other above the lines of weakness 40 to facilitate grasping and subsequent tearing of the upstanding panels 36 and 38. In another embodiment, a single line of weakness is formed at the juncture of the uppermost edges of the upstanding panels 36 and 38.

In yet another embodiment, the one-time breakable seal takes the form of a peelable seal. To create the peelable seal, the inner surfaces of one or both of the upstanding panels 36 and 38 above the slider 32 and zipper 22 are detachably connected to each other by a tacky adhesive-like substance that is well-known in the art.

In a further embodiment, the first and second upstanding panels 36 and 38 are fixedly connected to each other and no line of weakness is formed along or at the juncture of the panels. In this embodiment, the consumer gains entrance into the sealed pocket formed by the joined panels 36 and 38 by cutting off upper portions of the upstanding panels 36 and 38 with a cutting device such as a scissors, knife, or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable plastic bag, comprising:

first and second opposing body panels fixedly connected to each other along a pair of sides and a bottom bridging said pair of sides;

a zipper extending along a mouth formed opposite said bottom from one of said pair of sides to the other of said pair of sides, said zipper including a first track with a first profile and a second track with a second profile, said first and second profiles being releasably engageable to each other;

a slider slidably mounted to said zipper for movement between a closed position and an open position, said slider being immediately adjacent to said one of said pair of sides while in said closed position and being immediately adjacent to said other of said pair of sides while in said open position, said first and second profiles being engaged to each other in response to movement of said slider in a closing direction from said open position to said closed position, said first and second profiles being disengaged from each other in response to movement of said slider in an opening direction from said closed position to said open position; and first and second upstanding panels fixedly connected to and extending upwardly from said respective first and second body panels, each of said first and second upstanding panels including first and second opposing ends, the first and second opposing ends of said first upstanding panel being connected to the respective first and second opposing ends of said second upstanding panel to form a pocket in which said slider is captured, said connected first ends of said first and second upstanding panels terminating movement of said slider in said closing direction at said closed position, said connected second ends of said first and second upstanding panels terminating movement of said slider in said opening direction at said open position.

2. The plastic bag of claim 1, wherein said first and second upstanding panels are joined to each other above said slider to seal said pocket and fully encapsulate said slider within said sealed pocket.

3. The plastic bag of claim 2, wherein each of said first and second upstanding panels includes an uppermost edge, and the uppermost edge of said first upstanding panel is joined to the uppermost edge of said second upstanding panel.

4. The plastic bag of claim 2, wherein said joined first and second upstanding panels include one or more breakable lines of weakness for gaining access into said sealed pocket.

5. The plastic bag of claim 2, wherein said first and second upstanding panels are joined to each other above said slider by a peelable seal.

6. The plastic bag of claim 1, wherein said first and second upstanding panels are integrally formed with said respective first and second body panels.

7. In a reclosable plastic bag including first and second opposing panels fixedly connected to each other along a pair of sides and a bottom bridging said pair of sides; a zipper extending along a mouth formed opposite said bottom from one of said pair of sides to the other of said pair of sides, said zipper including a first track with a first profile and a second track with a second profile, said first and second profiles being releasably engageable to each other; and a slider slidably mounted to said zipper for movement between a closed position and an open position, said slider being immediately adjacent to said one of said pair of sides while in said closed position and being immediately adjacent to said other of said pair of sides while in said open position, said first and second profiles being engaged to each other in response to movement of said slider in a closing direction from said open position to said closed position, said first and second profiles being disengaged from each other in response to movement of said slider in an opening direction from said closed position to said open position, a slider-capturing arrangement comprising:

first and second upstanding panels fixedly connected to and extending upwardly from said respective first and second body panels, each of said first and second upstanding panels including first and second opposing ends, the first and second opposing ends of said first upstanding panel being connected to the respective first and second opposing ends of said second upstanding panel to form a pocket in which said slider is captured, said connected first ends of said first and second upstanding panels terminating movement of said slider in said closing direction at said closed position, said connected second ends of said first and second upstanding panels terminating movement of said slider in said opening direction at said open position.

8. The arrangement of claim 7, wherein said first and second upstanding panels are joined to each other above said slider to seal said pocket and fully encapsulate said slider within said sealed pocket.

9. The arrangement of claim 8, wherein each of said first and second upstanding panels includes an uppermost edge, and the uppermost edge of said first upstanding panel is joined to the uppermost edge of said second upstanding panel.

10. The arrangement of claim 8, wherein said joined first and second upstanding panels include one or more breakable lines of weakness for gaining access into said sealed pocket.

11. The arrangement of claim 8, wherein said first and second upstanding panels are joined to each other above said slider by a peelable seal.

* * * * *